US005188502A

United States Patent [19]

Tonsor et al.

[11] Patent Number: 5,188,502

[45] Date of Patent: Feb. 23, 1993

[54] LINKAGE ARRANGEMENT FOR A MULTI-PURPOSE VEHICLE

[75] Inventors: Andrew J. Tonsor, East Peoria, Ill.; Wilton E. Quant, St. Augustine, Fla.; Javad Hosseini, Peoria, Ill.; Michael F. Hopkins, Aurora, Ill.; William E. Allen, Peoria, Ill.

[73] Assignee: Caterpillar, Inc., Peoria, Ill.

[21] Appl. No.: 632,839

[22] Filed: Dec. 24, 1990

[51] Int. Cl.[5] ..... B66C 23/00

[52] U.S. Cl. ..... 414/700; 414/699

[58] Field of Search ..... 414/700, 701, 702, 699, 414/697

[56] References Cited

U.S. PATENT DOCUMENTS

| | | | |
|---|---|---|---|
| 3,831,683 | 8/1974 | Ikeda et al. | 172/4.5 |
| 4,288,196 | 9/1981 | Sutton, II | 414/699 |
| 4,324,525 | 4/1982 | Lane et al. | 414/699 |
| 4,768,917 | 9/1988 | Garman | 414/697 |
| 4,791,549 | 12/1988 | Heiser et al. | 364/167.01 |
| 4,844,685 | 7/1989 | Sagaser | 414/699 X |
| 4,889,466 | 12/1989 | Jindai et al. | 414/699 X |
| 4,934,463 | 6/1990 | Ishida | 172/4.5 |
| 4,964,779 | 10/1990 | Sagaser | 414/699 X |

FOREIGN PATENT DOCUMENTS

| | | |
|---|---|---|
| 0258819A1 | 9/1986 | European Pat. Off. . |
| 61-106834(A) | 5/1986 | Japan . |
| 9006403 | 6/1990 | PCT Int'l Appl. . |

OTHER PUBLICATIONS

Publication, Form No. S-7051, "Terex 72-61 Loader", Dated Jan., 1981.

Publication, Form AEHQ5677, "910 Wheel Loader", Dated Jul., 1985.

Publication, Form AEHQ8948, "IT12B Integrated Tool Carrier", Dated Jan., 1990.

*Primary Examiner*—Michael S. Huppert

*Assistant Examiner*—Donald W. Underwood

*Attorney, Agent, or Firm*—William C. Perry

[57] ABSTRACT

Construction vehicles of the type having a pair of lift arms extending from the frame to support a work implement, have generally been restricted to operating one specific tool. The attempt to combine the operation of several different work implements has been met with severe functional restrictions since some work implements have specific requirements not found in the operation of others. In order to provide a lift arm linkage arrangement that incorporates the functional requirements necessary to operate a plurality of work implements while maintaining a simple, yet efficient construction, an electronic controller has been included in the design. The electronic controller includes a plurality of sensors that are operatively associated with the lift and tilt linkage of the lift arm arrangement. The sensors enable the electronic controller to constantly monitor the current position of the lift arms and the work implement and compare them with a programmed sequence of movements. The electronic controller is further able to automatically adjust the position of the lift arms and the work implement in accordance with the programmed sequence.

25 Claims, 3 Drawing Sheets

CONTROL MODULE
92
94
138
100
140
98
90
96
110
117
112
130
117
132
106
108
116
126
128
102
104
115
124
120
135
137
148
118
134
148
48
84
150
44
62
114
122
46
86
136
122
136
152
142
144
150

62
178
144
146
148
164
152
154
184
158
180
168
170
182
176
156
174
160
172
166
162
150
186
134

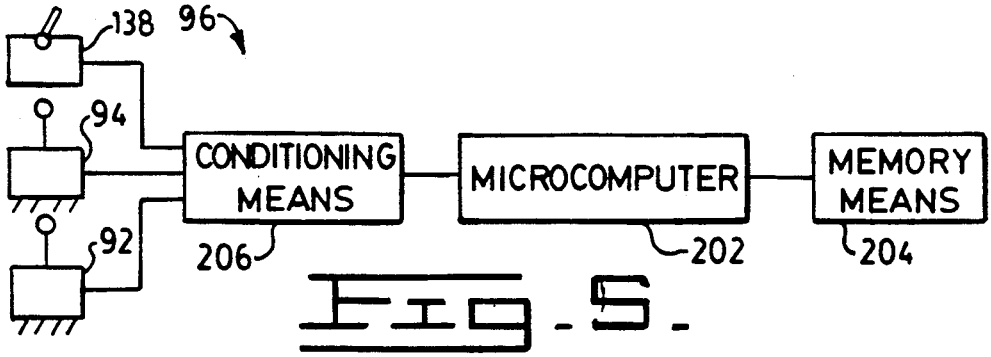
Fig. 5.
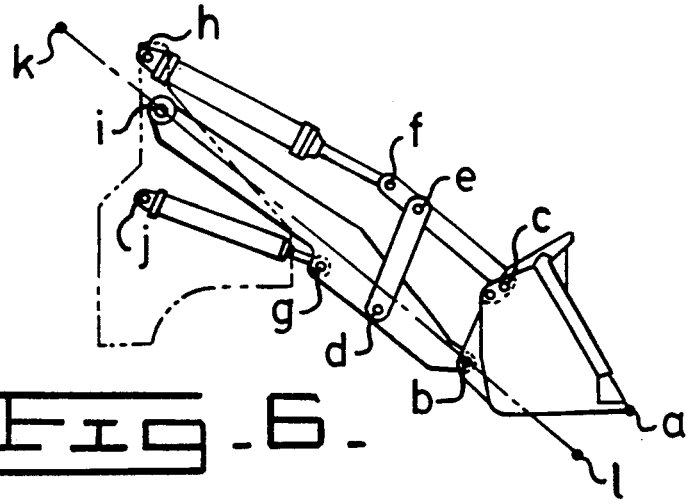
Fig. 6.
Fig. 7.
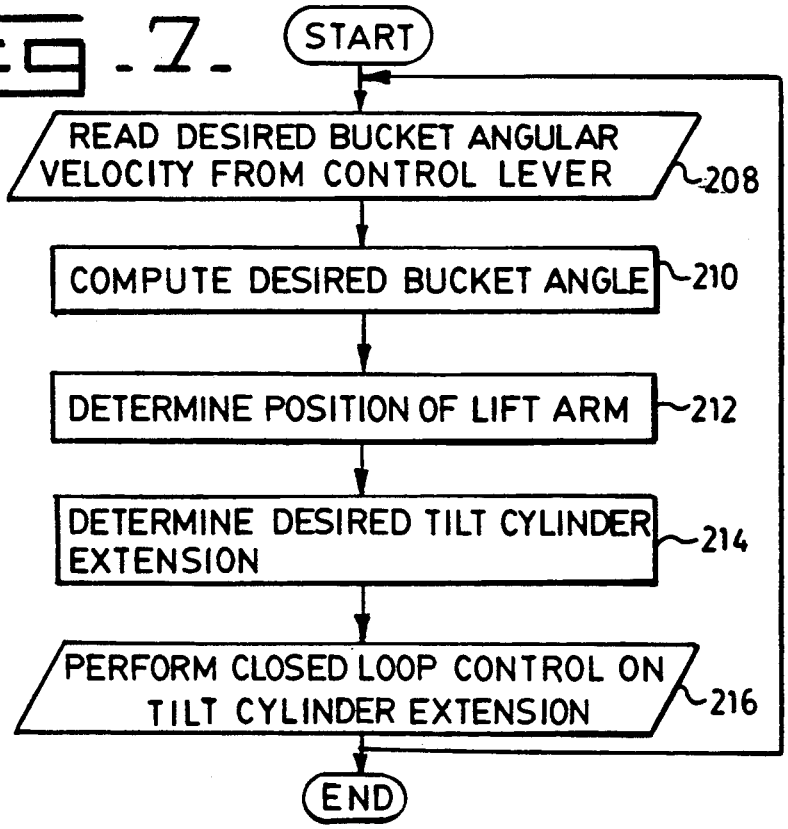

LINKAGE ARRANGEMENT FOR A MULTI-PURPOSE VEHICLE

1. Technical Field

This invention relates generally to linkage arrangements and more particularly to a linkage arrangement that connects a multiplicity of work implements to a construction vehicle.

2. Background Art

In the construction industry, it has been a recent trend to utilize machinery in a capacity that is as versatile as possible. As a result, several machines have been developed that will operate numerous tools. This is especially true for equipment such as small and mid-sized wheel loaders. In addition to utilizing the machines in a conventional capacity, i.e., removing and loading material utilizing by a bucket, they are often times equipped with various other work implements so they may perform other tasks. One example would be to replace the bucket with a pallet fork attachment to allow the vehicle to unload and stack items that may be secured to a pallet. In this capacity, the operational requirements are far different from those of a conventional wheel loader. Since the machine is utilized for stacking, greater visibility between the lift arms is required when the lift arms are elevated so the operator can see the placement of the forks and load. Visibility to this area is not as important when loading material into a bucket and dumping it into a truck. In this mode of operation visibility to the corners of the bucket is of primary importance.

In addition to widely varied visibility requirements, the force requirements to perform multiple operations are also different. For example, the force requirements to enable a tilt linkage to rotate a pallet fork implement with respect to the lift arms in a direction back toward the vehicle are far greater than those required to "rack back" a bucket. The additional force is most needed when the lift arms are elevated and a loaded pallet needs to be tilted rearwardly to provide clearance between the pallet and the stack. A conventional wheel loader, on the other hand, needs very little force from the tilt linkage in the rearward or "rack back" direction when the arms are elevated since they are normally rotating an empty bucket. The majority of the "rack back" force is generally required when the bucket is near ground level and the geometry of the tilt linkage provides better leverage.

A machine that fulfills these varied requirements as well as any in the industry is disclosed in an advertising brochure identified as AEHQ8949 and entitled "IT12B Integrated Toolcarrier." The brochure was published by Caterpillar Inc. in January of 1990. The integrated toolcarrier is a multipurpose vehicle specifically designed to be used with a number of different work implements such as a bucket, pallet forks, material handling arms (booms) or log and lumber forks, just to name a few of the options available. In order to compensate for the variety of visibility requirements, the integrated toolcarrier has a linkage that utilizes a pair of lift arms that are laterally spaced from each other. The lift cylinder and tilt linkage arrangements are mounted to the individual lift arms and are in general alignment with the respective lift arms to keep the area between the lift arms unobscured. This provides excellent visibility down the center of the lift arm arrangement which is essential when utilizing certain implements such as pallet forks. Conversely when the vehicle is utilizing a bucket, there is adequate visibility to the corners of the bucket for effective operation.

The tilt linkage of any lift arm configuration is provided to rotate the work implement with respect to the lift arms. With the various implements that are intended for use with a vehicle such as an integrated toolcarrier, the force requirements for the tilt linkage vary greatly. In order to fulfill the variety of force requirements, the tilt linkage is designed to provide tilt capability as uniform as practical over the entire range of lift heights. As previously discussed, this is especially important when utilizing a pallet fork attachment. The geometry of the tilt linkage is such that the tilt cylinder is mounted on a short extension that projects rearwardly from the pivot points and components of the tilt linkage. The extension provides a moment arm through which the available force of the tilt cylinder is increased, especially when the lift arms are elevated.

Another situation that must be addressed in a multipurpose vehicle is the attitude of the work implement when moving from the ground to a raised position. Unless some form of compensation is provided within the lift arm linkage, it is only natural for the work implement to rotate about the mounting of the lift arm to the frame as the lift arms are raised. This causes spillage of material from a bucket, or more critically, causes the forks of a pallet fork implement, and thus the load mounted thereon, to be inclined. In order to compensate for this on an integrated toolcarrier, a plurality of links connect the tilt cylinder to the frame. Each lift arm has one link that is pivotally mounted to it that extends both above and below each lift arm. This link is relatively large in mass when compared to the other components in the lift arm arrangement, aside from the lift arms themselves. A second link anchors this link to the frame and, as a result, allows the mounting of the tilt cylinder to move with respect to the lift arms as they are raised. This allows the attitude of the implement to remain unchanged. A major drawback to this type of level lift arrangement resides in the amount of weight and cost the four extra links (two per lift arm) add to the lift arm arrangement. A linkage configuration of this type also makes the routing of the hydraulic lines to the tilt cylinders more difficult. In addition, since all the links are rotatably mounted, maintenance of the six additional pinned connections is also required.

In some conventional wheel loader applications, the compensating links have been eliminated and the tilt cylinder is mounted directly to the vehicle frame. One arrangement of this type is disclosed in literature entitled "Terex 72-61 Loader" that is identified as Form No. S-7051, published in January of 1981 by Equipment Guide Book Division, Nielson/DATAQUEST. Another example is shown in a brochure identified as AEHQ5677 entitled "910 Wheel Loader" and published by Caterpillar Inc. in July of 1985. It must be pointed out, however, that while these machines have the tilt cylinders mounted directly to the frame, the mounting does not lend itself well for use with a multipurpose vehicle. These vehicles are intended primarily for use as bucket loaders and do not require an inherent mechanism within the lift arm arrangement to provide a level lift. Whatever adjustment needs to be made as the lift arms are raised, may easily be made by the operator through manual adjustment of the tilt cylinder controls. An automatic or inherent level lift could be provided by attaching the tilt cylinder to the frame of the vehicle at a location that is elevationally higher than what is shown in the brochures. If this were done, however, the mounting panel would be in a position directly in front of the operator, obscuring his visibility to critical areas of the lift arm linkages. The sacrifices in visibility would far outweigh any benefits gained by raising the mounting points of the lift arms with respect to the vehicle frame and severely restrict the use of the machine as a multi-purpose vehicle.

Other examples of methods for maintaining the attitude of a work implement throughout a range of vertical movement are typically shown in U.S. Pat. No. 4,791,549, issued to Heiser et al. on Dec. 13, 1988. This patent teaches the means by which a pallet fork, mounted on a boom, is moved in a straight line in either a horizontal or vertical direction. A plurality of sensors measure the length of the boom and the angle with respect to a horizontal reference. The respective sensors input the location data into a microcomputer which in turn causes the manipulation of the lift and extension cylinders of the boom to automatically achieve straight line travel of the pallet forks. This control system is shown for use with a vehicle whose purpose is singular in nature. While the application of the control system aids in the operation of the vehicle it does not enhance its application for use with other work implements nor does it eliminate any of the linkage components.

The present invention is directed to overcoming one or more of the problems set forth above.

DISCLOSURE OF THE INVENTION

In one aspect of the present invention a linkage arrangement is adapted for connecting a work implement to the frame of a vehicle. The linkage arrangement includes a pair of lift arms that have a first end portion connected to the frame and a second end portion connected to the work implement. The lift arms are positioned in spaced, parallel relation to each other on opposite sides of a longitudinal centerline defined by the vehicle. A lifting means is provided to move the lift arms about the first end portions thereof in a generally vertical plane. The lifting means is positioned in generally vertical alignment with the respective lift arms. A pair of first tilt links having a first and second end portion is positioned in substantially the same vertical plane as that of the respective lift arms with the first end portion mounted to the work implement. A pair of second links is provided that has a first end portion pivotally connected to the respective lift arms while a second end portion is pivotally mounted to the respective first links at a point that is intermediate their end portions. The second links are positioned in substantially the same vertical plane as that of the respective lift arms. A tilting means is provided for rotating the work implement about its mounting with the lift arms. The tilting means includes a pair of fluid actuated cylinders that are pivotally connected directly between the respective second end portions of the first tilting links and the vehicle frame. An electronic control means is provided for measuring the actual position of the work implement with respect to the lift arms. The electronic control member calculates the variance between the actual angular relationship of the work implement and as well as the lift arm movement, to that of a predetermined angular relationship of the work implement with respect to the vehicle. The electronic control means then automatically controls the tilting means to achieve and maintain said predetermined angular relationship of the work implement throughout the movement of the lift arm.

In another aspect of the invention a linkage arrangement is adapted to attach work implements to the frame of a vehicle that is intended to operate with a plurality of work implements. A pair of lift arms is provided that have a first and second end portions and are mounted to the vehicle frame in spaced, parallel relation to one another. The first end portions of the lift arms are pivotally mounted to the frame and the second end portions are mounted to one of the work implements. A tilt linkage is connected between each lift arm and the work implement to provide rotation of the work implement about its mounting with the lift arms. A first fluid actuator is pivotally connected between each tilt linkage and the vehicle frame. Each fluid actuator is positioned so as to be aligned generally along a vertical plane that is common to both the lift arms and tilt linkage. A second fluid actuator is pivotally connected between the vehicle frame and each of the respective lift arms to provide movement of the lift arms in a generally vertical plane. Each of the second fluid actuators is positioned to be generally aligned in the same plane as the respective lift arms and their mounting to the vehicle frame. An electronic control means is provided for sensing the position of the respective lift arms and work implement and automatically providing coordinated manipulation of the first and second actuators to move the lift arms and work implement through a preselected sequence of maneuvers that is programmed therein.

With a lift arm arrangement as set forth above, a machine is provided with the capability of operating a multiplicity of diverse work implements. The work implements may be operated in a highly efficient manner without sacrificing any capability in the operation of one implement with respect to another. The linkage is such that it provides excellent visibility to critical areas of several different work implements. The tilt linkage geometry is such that it provides sufficient force to accommodate the variety of functional requirements that are particular to various individual work implements. And finally, with the addition of the electronic control means, certain functions and/or preselected paths of movement for the lift arms and the work implement may be programmed and automatically carried out. These features have been combined in a lift arm linkage arrangement that is lightweight and economical in structure and extremely efficient in operation.

BRIEF DESCRIPTION OF THE DRAWINGS

FIG. 5 is a block diagram of an embodiment of the electronic control means that embodies the principles of the present invention;

FIG. 6 is a diagrammatic view of the work implement illustrating pertinent points on the work implement; and FIG. 7 is a flow diagram of the parallel lift controller.

BEST MODE FOR CARRYING OUT THE INVENTION

Figure 1:
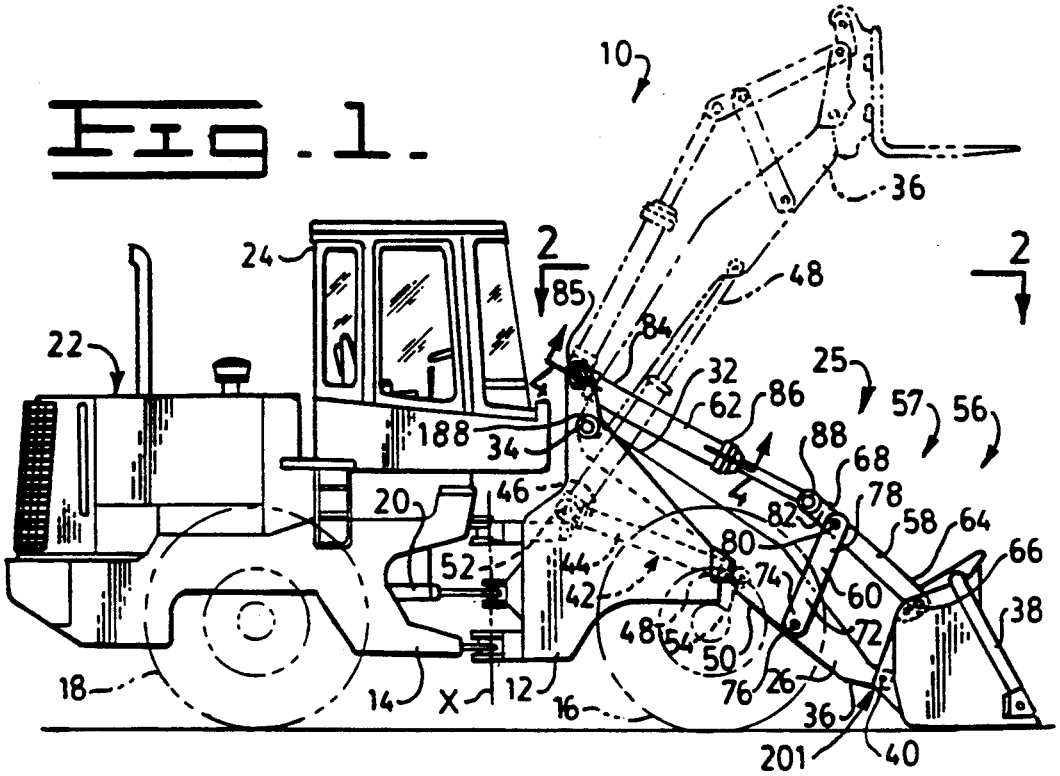
FIG. 1 is a side elevational view of a vehicle having a lift arm linkage that embodies the principles of the present invention.

Referring to the drawings a vehicle 10 is shown having a front frame 12 and a rear frame 14 that are pinned together about a vertical centerline X. Each of the frames is supported by a pair of wheels 16 and 18 respectively. A pair of hydraulic cylinders 20 (one shown) are connected between the front and rear frames 12 and 14 and are selectively actuatable to cause the frames to rotate with respect to each other about the centerline X to steer the vehicle. At least the rear pair of wheels 18 receives power to drive the vehicle 10 from an engine (not shown) that is housed within a compartment 22 supported on the rear frame 14. A cab 24 or operator's station, from where the vehicle may be operated, is also mounted on the rear frame 14. A lift arm linkage arrangement 25 is mounted to the front frame 12 and extends forwardly therefrom. The lift arm linkage arrangement 25 includes a pair of lift arms 26 that are connected to the frame 12 at spaced locations 28 and 30 (FIG. 2) so as to be positioned on opposite sides of the vehicle centerline X'. Since both lift arms 26 are essentially identical, common reference numerals will be used to identify identical components on each lift arm. Each lift arm has a first end portion 32 that is mounted to the frame 12 by a pin assembly 34 that allows relative rotation therebetween. A second end 36 (FIG. 1) of each lift arm 26 is positioned in front of the vehicle 10 and is attached to a work implement 38. The work implement 38 and lift arms 26 are also connected by a pin assembly 40 to permit relative rotation therebetween. While the work implement 38 shown in the drawings is a bucket, it is to be understood that the lift arms 26 may also be mounted to a work implement in the form of a quick coupler that will allow the lift arms to be adaptable to mount other implements such as a pallet fork, which is shown in phantom in FIG. 1. Other implements such as log handling equipment and various other construction related implements are also adaptable for use with a lift arm linkage arrangement that utilizes a quick coupler.

A means 42 by which the lift arms 26 may be simultaneously raised is positioned between the frame 12 and each lift arm 26 so as to be below and generally in line with the lift arms 26. In the illustrated embodiment, the lifting means 42 includes a first fluid actuator such as a hydraulic cylinder 44. Each cylinder 44 has a first or head end portion 46 rotatably mounted to the frame 12 and a second or rod end portion 48 rotatably mounted to the mid-portion 50 of the lift arms. Both end portions 46 and 48 of the cylinders 44 are rotatably mounted by pin assemblies 52 and 54 respectively to permit relative rotation between the respective components. When the hydraulic cylinders 44 are actuated in a well known manner, the rod end 48 is extended and the lift arms 26 are caused to rotate about the first end portion 32 thereof, raising the second end portion 36 and thus the work implement 38 in a generally vertical plane.

Figure 2:
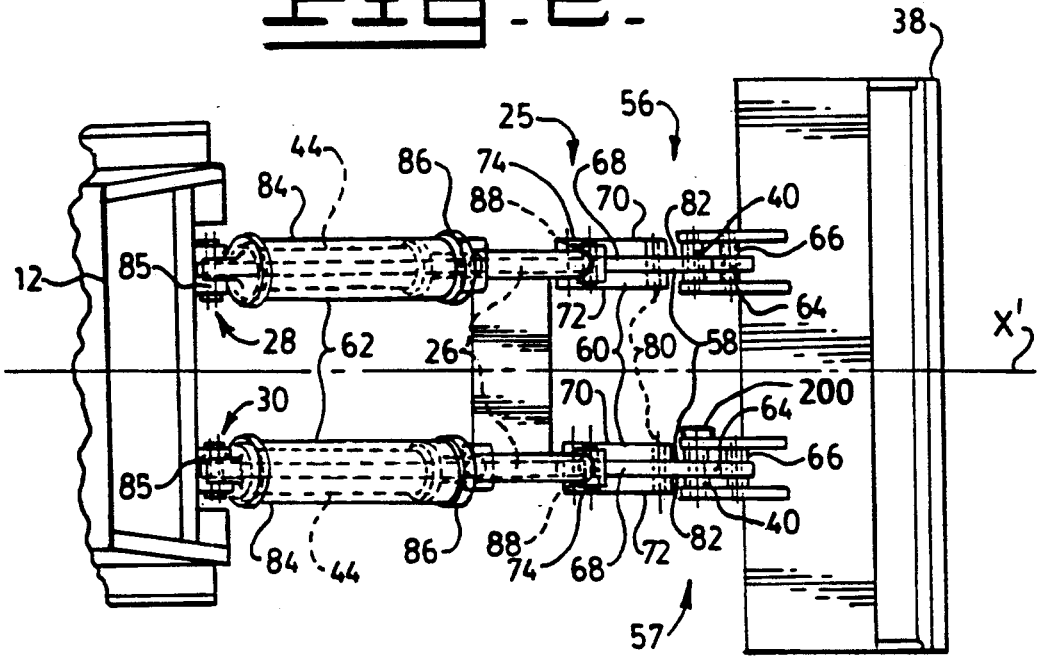
FIG. 2 is a fragmentary top elevational plan view taken along lines 2—2 of FIG. 1.

Each lift arm 26 is also provided with a means 56 by which the work implement 38 may be tilted with respect to the lift arms 26 about the mounting pin 40. The tilt means 56 includes a linkage arrangement 57 that incorporates a first and second link member 58 and 60 and a second fluid actuator such as a hydraulic cylinder commonly referred to as a tilt cylinder 62. The first tilt link member 58 has a first end portion 64 that is pivotally connected to the work implement 38 by a pin assembly 66. The point of attachment is spaced elevationally above and generally in line with the second end portion 36 of the lift arm 26. The first tilt link 58 extends rearwardly toward the vehicle 10 in substantially parallel relation to the lift arm 26 and terminates at a second end portion 68. The second tilt link 60 is a two part composite link having a first and second side plates 70 and 72 (FIG. 2) that straddle the lift arm 26 and the first tilt link 58 spanning the distance therebetween. The second tilt link 60 has a first end portion 74 that is rotatably mounted to the lift arm 26 by a pin assembly 76. A second end portion 78 of the second tilt link 60 is rotatably mounted to the first tilt link (58) by pin assembly 80. The point of attachment between the second tilt link and the first tilt link occurs intermediate the end portions 64 and 68 of the first tilt link 58. This creates an extension 82 that projects rearwardly beyond the point of attachment between the two tilt links 58 and 60. The hydraulic tilt cylinder 62 is conventional in construction and operation having a first, or head, end (84) and a second, or rod end 86. The rod end 86 of the tilt cylinder is pivotally mounted to the second end portion 68 of the first tilt link 58 by a pin assembly 88 (FIG. 1). The head end 84 of the tilt cylinder 62 is mounted to the vehicle frame 12 at a location 85 that is spaced elevationally from and generally in line with the points of attachment 28 and 30 between the lift arm 26 and the frame 12. Being so arranged, the entire tilt linkage assembly 56 is positioned to be generally in line with the respective lift arms 26.

The lift arm linkage arrangement 25 is provided with an electronic control means 90 that will allow numerous functions to be performed automatically at the operators discretion. The operation and function of the linkage arrangement and the control means 90 is best illustrated in the schematic diagram of FIG. 3. A pair of control levers 92 and 94 control the function of the lift and tilt cylinders 44 and 62 respectively. Each control lever 92, 94 is movable in two directions along a single axis. Movement of the control lever 92, 94 in each direction corresponds to the desired velocity (magnitude and directions) of the respective cylinder 44, 62.

The control levers 92 and 94 are connected to a control module or controller 96 via electrical wires 98 and 100 respectively. The controller 96 communicates with a pair of electro-hydraulic valves 102 and 104 that control the lift and tilt cylinders 44 and 62 respectively. The lift control valve 102 has a pair of solenoids 106 and 108 positioned on opposing ends thereof. Each solenoid 106, 108 is connected to the controller 96 via respective electrical wires 110 and 112. The valve is also in communication with a source 114 of fluid that is delivered to the valves 102 and 104 under pressure by a pump 115 through a pair of conduits 116 and 117. The valve, in turn, selectively directs the pressurized fluid to the lift cylinders 44. Each cylinder has a port 118 at the head end 48 thereof that is in communication with the control valve 102 via conduit 120. A second port 122 is positioned at the rod end 46 of the cylinders 44 and is in communication with the control valve 102 via conduit 124. The cylinders are connected in such a manner so that the pressurized fluid is selectively directed to the respective rod ends 46 or head ends 48 to simultaneously extend or retract both cylinders. The tilt control valve 104 is virtually identical to the lift control valve 102 except that it directs pressurized fluid to the tilt cylinders 62 by selective actuation of a pair of solenoids 126 and 128 that are positioned on opposite ends of the valve 104. The solenoids 126 and 128 are connected to the controller 96 via wires 130 and 132. Like the lift control valve 102, the tilt control valve 104 is in fluid communication with the source 114 of pressurized fluid by way of the conduits 116 and 117. The valve 104 selectively communicates the pressurized fluid to a port 134 (FIG. 4) on the head end 84 of the tilt cylinders 62 via conduit 137 or to a port 136 on the rod ends 86 of the tilt cylinders 62 via conduit 135 to extend or retract them simultaneously.

At least one switch 138 is in communication with the controller 96 via wire 140 and determines whether the manipulation of the lift and tilt cylinders 44 and 62 respectively, will occur manually through manipulation of the control levers 92 and 94 or automatically through a programmed function contained within the controller 96. Automatic control relies upon input from sensing means 142 and 144 that are associated with the lift and tilt cylinders 44 and 62 respectively.

Figure 3:
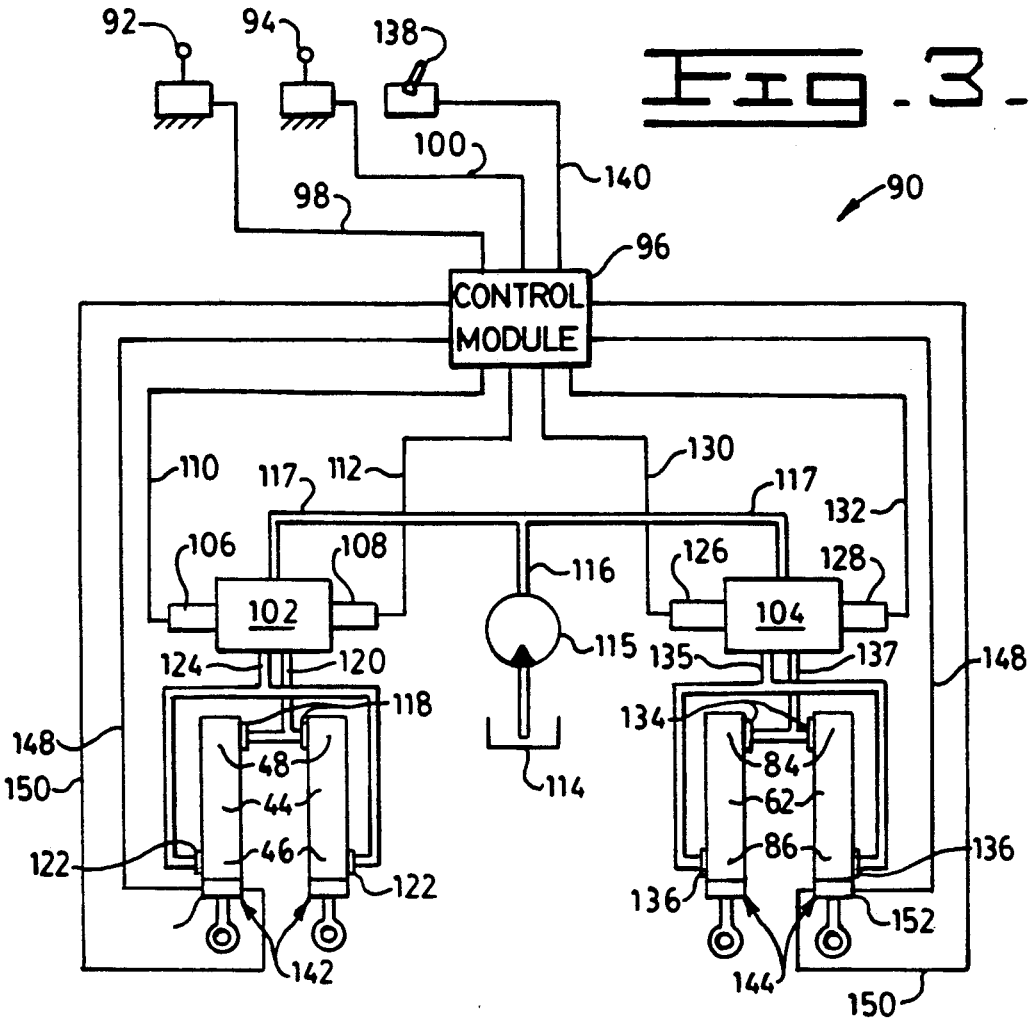
FIG. 3 is a schematic diagram of the electro-hydraulic circuit of the preferred embodiment of the system according to the invention.
Figure 4:
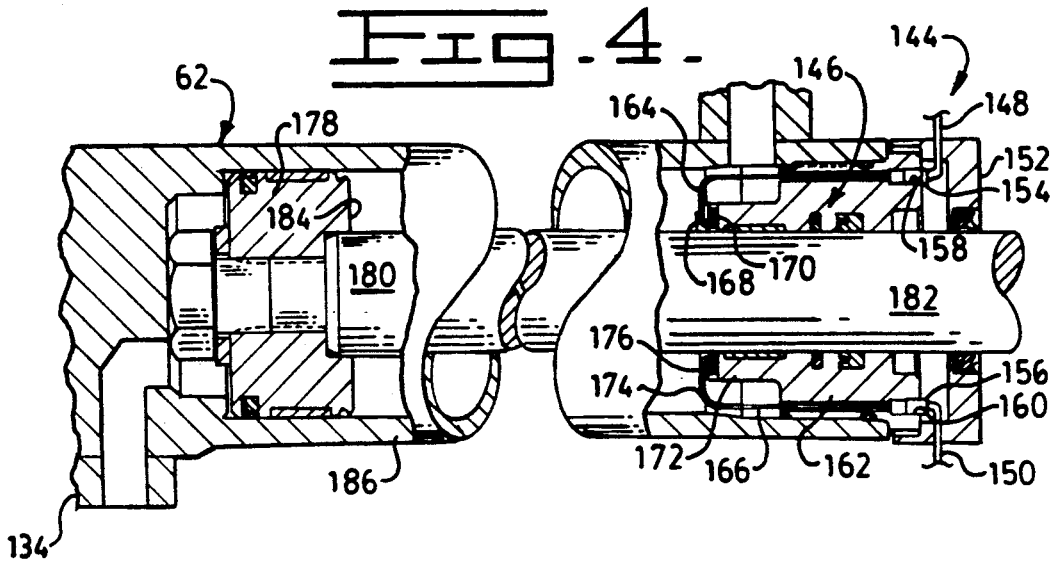
FIG. 4 is a fragmentary sectional view taken along lines 4—4 of FIG. 1.

The sensing means 142 and 144 may be one of several different varieties. In one embodiment, the sensing means 142, 144 may include sensors which produce signals indicative of the relative retraction/extension of the respective cylinder 44, 62. In the illustrated embodiment a radio frequency sensor 146, commonly known as an RF sensor, is incorporated into one of the lift cylinders 44 as well as one of the tilt cylinders 62 to determine the amount of cylinder extension. A sensor of this type is more fully described in U.S. Pat. No. 4,737,705 issued to Bitar et al. on Apr. 12, 1988. Since the sensors incorporated in the lift and tilt cylinders are identical, only the sensor associated with the tilt cylinder 62 will be described in detail; it being understood that the operation will be the same in both the lift and tilt cylinders. Referring now to FIGS. 3 and 4, it can be seen that the controller 96 is connected to the respective cylinders 44 and 62 by way of a pair of coaxial cables 148 and 150 that are received within a housing 152 located on the rod ends 46 and 86 of the respective cylinders 44 and 62. The cables extend through the housing 152 and have a threaded end portion 154 and 156 that is received within a pair of threaded apertures 158 and 160 that are located 180° apart in an end cap 162 that closes off the cylinder. A pair of antennas 164 and 166 are connected to the coaxial cables 148 and 150 respectively. The distal end 168 of antenna 164 is grounded to the cylinder end cap 162 by a set screw 170 at an inward end portion 172 thereof. Similarly, the distal end portion 174 of the antenna 166 is grounded to the inward end portion 172 of the end cap 162 by a set screw 176. A piston 178 is secured to the innermost end 180 of the cylinder rod 182 and defines a signal reflecting wall 184 that faces the antennas 164 and 166. The piston is positioned between ports 134 and 136 defined in the cylinder and responds to the selective communication of pressurized fluid to the respective ports 118 and 122 to cause the extension and retraction of the rod 182 with respect to the cylinder body portion or housing 186.

A rotary potentiometer 188 may be alternatively incorporated into the mounting 28 of the first end portion 32 of the lift arms to the front frame 12 to determine the position of the lift arms 26. This type of sensor will measure the angle between the lift arm 26 and the frame 12 and send a corresponding signal to the controller 96. Once the controller 96 receives the signal, the joint angle measurement may be computed by trigonometric methods. Such techniques for determining bucket position are well known in the art and may be found in, for example, U.S. Pat. No. 3,997,071 issued to Teach on Dec. 14, 1976 and U.S. Pat. No. 4,377,043 issued to Inui et al. on Mar. 22, 1983. A similar sensor 200 can be incorporated into one of the pivotal mountings of the tilt means 56 which in the present instance is indicated by reference 201 in FIG. 1. The sensor 200 provides the controller 96 with a signal for use in measuring the angle of the work implement 38 with respect to the lift arms 26.

With reference to FIG. 5, the controller 96 includes a microprocessor 202, memory means 204 and signal conditioning means 206. One suitable microprocessor 202 is provided by Motorola Inc. of Roselle, Ill. (part number 68HC11). However, any similar device may be used. The microprocessor 202 is under the control of preprogrammed instructions (computer program) which are stored in the memory means 204. The conditioning means 206 receives the signals from the control levers 92, 94, the switch 138, and the sensing means 142, 144, and processes the signals for delivery to the microprocessor 202. In the preferred embodiment, the conditioning means 206 includes low-pass filters (not shown) to remove noise from the signals. Analog to digital converters (A/D converters) contained within the microprocessor 202 digitize the filtered signals. The microprocessor 202 also delivers signals to the electrohydraulic control valves 102, 104 to control movement of the lift arm linkage arrangement 25. In addition the microprocessor 202 stores data regarding the linkage positions in the memory means 204. Controller configurations, as discussed above, are well known in the art and are therefore not discussed further.

In the preferred embodiment, the controller 96 is switchable between a manual mode and one or more automatic modes.

In the manual mode, actuation of the hydraulic lift and tilt cylinders 44, 62 is controlled by an operator through movement of the respective control levers 92, 94.

In a first automatic mode, the controller 96 automatically moves the work implement 38 to a plurality of preprogrammed positions. For example, if the work implement 38 is a bucket, the vehicle is maneuvered by the operator through a work cycle. Typically, the work cycle includes digging, loading, carrying and dumping operations.

In one embodiment, each control lever 92, 94 includes one or more detented or locked positions corresponding to respective preprogrammed linkage, positions. For example, the tilt control lever 94 has a TILT-BACK detented position and a DUMP detented position. When the tilt control lever 94 is positioned in the TILT-BACK detent position, the control lever 94 locks and the tilting means 56 is actuated to move the linkage to an operator programmable RACK-BACK position. When the tilt control lever 94 is moved in the opposite direction and locked into the DUMP detent position, the tilting means 56 is actuated to move the linkage to an operator programmable DUMP position. Similarly, the lift control lever 92, has RAISE and LOWER detented positions. A control system capable of the functions described above is disclosed in U.S. Pat. No. 5,052,883 issued to Izuru Morita et al. on Oct. 1, 1991.

In another embodiment, the controller 96 actuates the tilting and lifting means 42, 56 to automatically move the lift arm linkage arrangement 25 through a work cycle defined by a plurality of operator programmable lift arm and tilt linkage positions. For example, the controller 96 may automatically actuate the lifting and tilting means 42, 56 to provide "return to carry" and "return to dump" movements of the work implement 38.

In another automatic mode, the controller 96 automatically provides a parallel lift function of the work implement 38. That is, an angular relationship of the work implement 38 is maintained during movement of the lift arms 26. The angular relationship is defined by a line of the work implement 38 (explained below) and a horizontal. The words "parallel lift" are used in reference to the fact that the line of the work implement at a new position is parallel to the line of the work implement at the old position (as explained below).

In one embodiment, the raising/lowering of the lift arms 26 is controlled through the operator's use of the control lever 90 as in the manual mode. The controller 96 automatically actuates the tilting means 56 to maintain the angular relationship between the work implement 38 and the vehicle 10. In another embodiment, the controller 96 automatically moves the lift arms 26 to a preprogrammable position (see discussion above) while maintaining the angular relationship between the work implement 38 and the vehicle 10.

In the following discussion describing the parallel lift function, the work implement 38 is referred to as a bucket. The parallel function for other work implements is similar.

For the calculations used to provide the parallel lift function, the following designations are used:

L—a length of constant magnitude,

λ—length of varying magnitude,

A—an angle of constant magnitude, and

θ—an angle of varying magnitude.

With reference to FIG. 6, each length (L, λ) has two subscripts, which define the two points between which the length is referenced. Each angle (A, θ) has three subscripts, which define the lines between which the angle is measured (the middle subscript being the vertex of the angle).

With reference to FIG. 7, the controller 96 is adapted to maintain an angular relationship, $\theta_{abl}$ or bucket angle, between lines $L_{kl}$ and $L_{ab}$ during actuation of the lifting means 42. As shown, the angular relationship between the work implement 38 and the work vehicle 10 is measured with reference to a stationary axis defined by $L_{kl}$ which passes through point b. For discussion purposes only, $L_{kl}$ is shown as passing through point i.

In one embodiment, the operator may adjust the bucket angle $\theta_{abl}$ while the parallel lift function is enabled. Accordingly, in control block 208, the signal from the tilt control lever 94 is read. The signal from the tilt control lever 94 is proportional to the desired angular velocity of the bucket. Therefore, in control block 210, a new desired bucket angle ($\theta_{abl}$) is calculated by integrating the desired angular velocity of the bucket and combining the result with the present bucket angle (if the control lever 94 is not actuated the bucket angle is not modified). In the preferred embodiment, the bucket angle cannot be modified by more than +/−3 degrees at a time (one control loop).

In control block 212, an angular relationship between the lift arms 26 and the vehicle 10 is determined. In the preferred embodiment, the sensing means 144 delivers a signal indicative of the lift cylinder displacement, $\lambda_{gj}$. In an alternate embodiment, the sensing means delivers a signal indicative of an angular relationship between the lift arms 26 and the vehicle 10.

Based on the lift cylinder extension, $\lambda_{gj}$, and the geometry of the linkage arrangement, the desired tilt cylinder extension, $\lambda_{fh}$, is determined in control block 214. In the preferred embodiment, the calculations used to determine $\lambda_{fh}$ are:

$$\theta_{gij} = \cos^{-1}((L_{ij}^2 + L_{ig}^2 - \lambda_{gj}^2)/(2*L_{ij}*L_{ig})) \quad (1)$$
$$\theta_{TEMP1} = \theta_{gij} + \theta_{big} - \theta_{xij} \quad (2)$$
$$\theta_{TEMP2} = \theta_{abl} - \theta_{TEMP1} \quad (3)$$
$$\theta_{abi} = \pi - \theta_{TEMP2} + \theta_{abx} \quad (4)$$
$$\theta_{cbd} = \theta_{abi} + A_{dbl} - A_{abc} \quad (5)$$
$$\lambda_{cd} = \mathrm{sqrt}(L_{bc}^2 + L_{bd}^2 - 2*L_{bc}*L_{bd}*\cos(\theta_{cbd})) \quad (6)$$
$$\theta_{ced} = \cos^{-1}((L_{ce}^2 + L_{de}^2 - \lambda_{cd}^2)/(2*\lambda_{ce}*L_{de})) \quad (7)$$
$$\theta_{def} = A_{cef} - \theta_{ced} \quad (8)$$
$$\lambda_{df} = \mathrm{sqrt}(L_{de}^2 + L_{ef}^2 - 2*L_{de}*L_{ef}*\cos(\Theta_{def})) \quad (9)$$
$$\theta_{bdc} = \sin^{-1}(L_{bc}*\sin(\Theta_{cbd})/\lambda_{cd}) \quad (10)$$
$$\theta_{cde} = \cos^{-1}((\lambda_{cd}^2 + L_{de}^2 - L_{ce}^2)/(2*\lambda_{cd}*L_{de})) \quad (11)$$
$$\theta_{bde} = \theta_{bdc} + \theta_{cde} \quad (12)$$
$$\theta_{edi} = A_{bdi} - \theta_{bde} \quad (13)$$
$$\theta_{edf} = \cos^{-1}(L_{de}^2 + \lambda_{df}^2 - L_{ef}^2)/(2*L_{de}*\lambda_{df})) \quad (14)$$
$$\theta_{fdi} = \theta_{edi} - \theta_{eds} \quad (15)$$
$$\lambda_{fi} = \mathrm{sqrt}(\lambda_{df}^2 + L_{di}^2 - 2*L_{df}*L_{di}*\cos(\Theta_{fdi})) \quad (16)$$
$$\theta_{dif} = \cos^{-1}((L_{di}^2 + \lambda_{fi}^2 - \lambda_{df}^2)/(2*L_{di}*\lambda_{fi})) \quad (17)$$
$$\theta_{bif} = \theta_{dif} - A_{bid} \quad (18)$$
$$\theta_{fih} = A_{hix} - \theta_{TEMP1} - \theta_{bif} \quad (19)$$
$$\lambda_{fh} = \mathrm{sqrt}(\lambda_{fi}^2 + L_{hi}^2 - 2*\lambda_{fi}*L_{hi}*\cos(\Theta_{fih})) \quad (20)$$

Where, point x refers to a point on a horizontal axis relative to the vehicle 10 passing through the vertex of the angle.

In control block 216, the controller 96 actuates the tilting means 56 to the desired tilt cylinder extension. Preferably, the controller 96 uses a closed loop control with position feedback to calculate the next desired position the linkage arrangement 25 and to actuate the tilting means 56. The use of position feedback closed loop controls are well known in the art. Additionally, the closed loop control may include tilt cylinder velocity feedback and feed forward. A suitable control system utilizing position and velocity feedback and feed forward is disclosed in U.S. application number 07/540726 filed on Jun. 15, 1990.

While the parallel lift function is enabled (through the switch 138), control returns to control block 208, and the desired bucket angle is recomputed. This process is repeated until the parallel lift function is disabled. After the parallel lift function is disabled, the work implement 38 is again under the control of the control levers 92, 94.

INDUSTRIAL APPLICABILITY

In operation, the manipulation of the lift arms 26 and the work implement 38 of the vehicle 10 may be accomplished by conventional operation of the lift and tilt control levers 92 and 94 respectively. For example, when raising the lift arms 26 the control lever 92 may be moved in a direction to actuate one of the solenoids 106 or 108 connected to the electro-hydraulic valve 102. Actuation of one of the solenoids 106, 108 causes the valve to shift, communicating pressurized fluid from the conduits 116 and 117 to one of the rod or head ends 46 and 48 respectively, of the lift cylinders 44 which results in the extension or retraction of the cylinders. Likewise, movement of the tilt control lever 94 actuates one of the solenoids 126 and 128 associated with the tilt control valve 104. This, in turn, communicates pressurized fluid from the conduits 116, 117 to either of the head or rod ends 84 and 86 respectively of the tilt cylinders 62 to adjust the attitude of the work implement.

When it is desirable to incorporate an automatic function into the operation of the lift arm arrangement 25, the controller 96 must be introduced into the system. In the illustrated embodiment, the parallel (level) lift function is disclosed and is actuated by the movement of the toggle switch 138. When the switch is actuated, the controller 96 sends an input signal via cables 148 and 150 to the antennas 164 and 166 in sensing means 142 and 144 associated with the lift and tilt cylinders 44 and 62 respectively. In each sensor, the signal is directed toward and reflected from the wall 184 of the piston 178 by antenna 164. The reflected signal is received by the opposing antenna 166. The distance between the antennas and the piston end wall establishes a frequency that in this particular application ranges from 50 Megahertz (Mhz) to 1.5 Gigahertz (Ghz). The frequency changes as the piston 178 moves with respect to the antennas. The signal is continually being sent back to the controller 96 via cable 150 to provide a constant reading of the location of the piston 178 within the cylinder housing 186 to monitor the extension of the respective cylinders 44 and 62. The controller 96 is provided with the capability of having a desired sequence of cylinder positions programmed into its memory by the vehicle operator (see discussion above). Once the desired movements have been programmed, the controller 96 constantly reads the current position of the lift and tilt cylinders 44 and 62 and compares them to the desired programmed position. Any deviation in position may be automatically adjusted by the controller 96 through manipulation of the control valves 102 and 104. Therefore, once the parameters of movement of the lift arms 26 and tilt means 56 have been set to provide a level lift of the work implement 38 throughout a specified height of lift arm movement, the electronic control means 90 may be employed to automatically move the lift arm linkage arrangement 25 through the desired motion.

When rotary potentiometers are being employed, the sensor 188 measures the actual angular relationship between the lift arm and the vehicle frame and the sensor 201 measures the actual angular relationship between the work implement and the lift arm. The rotary potentiometers input the actual angular relationships between the respective components into the controller 96 in a manner similar to that described above with respect to the sensors mounted within the lift and tilt cylinders 44 and 62. Likewise, the controller 96 responds in a manner as previously described by constantly monitoring the actual angular relationships of respective components and comparing them to a programmed sequence. The controller then automatically adjusts the control valves 102 and 104 to compensate for any deviation between the actual angular relationships and the programmed sequence to maintain the predetermined angular relationship of the work implement with respect to the vehicle.

A lift arm arrangement provided with this capability allows the configuration of the lift arm linkage to remain relatively simple in construction by allowing the elimination of additional, more complex componentry which greatly increases the overall cost and weight. It also allows the lift arm linkage arrangement to incorporate visibility advantages inherent in some linkage arrangements with the force transmitting advantages inherent in others into a single, extremely versatile arrangement. The incorporation of an electronic control into the lift arm linkage arrangement 25 expands the possibilities for use in other capacities. For example, mechanical kickout arrangements may be eliminated through additional programming of the controller 96. The automatic positioning of the lift arms 26 and work implement 38 can easily be programmed to provide a "return to dig" or "return to carry" position for a bucket or an automatic hold position for use in pipelaying. With additional sensors and programming, the base system as described could also be enhanced to include such features as payload or "safe" load monitoring. This feature would allow the weight of each load to be automatically weighed or alternatively establish a maximum amount of load to be handled.

Other aspects, objects and advantages of this invention can be obtained from a study of the drawings, the disclosure and the appended claims.

We claim:

1. A linkage arrangement adapted for connecting a work implement to a frame of a vehicle comprising:

a pair of lift arms having a first end portion connected to the vehicle frame and a second end portion connected to the work implement, said lift arms being positioned in spaced, parallel relation to each other on opposite sides of a longitudinal centerline defined by the vehicle;

a lifting means for providing movement of the lift arms about the first end portions thereof in a generally vertical plane, said lifting means being positioned in generally vertical alignment with each of the respective lift arms;

a pair of first tilt links having a first end portion pivotally mounted to the work implement and a second end portion, said first tilt links being positioned in substantially the same vertical plane as that of the respective lift arms;

a pair of second tilt links having a first end portion pivotally connected to the respective lift arms and a second end portion pivotally mounted to the first tilt links at a location that is intermediate the first and second end portions of the first tilt links, said second tilt links being positioned in substantially the same vertical plane as that of the respective lift arms;

a tilting means for providing rotation of the work implement about its mounting to the lift arms, said tilting means having a pair of fluid actuated cylinders pivotally connected directly between the respective second end portions of the first tilt links and the vehicle frame and positioned in substantially the same vertical plane as that of the respective lift arms; and electronic control means for measuring the actual angular relationship of the work implement with respect to the lift arms, calculating the variance between said actual angular relationship of the work implement to that of a predetermined angular relationship of the work implement with respect to the vehicle and controlling the tilting means to achieve and maintain said predetermined angular relationship of the work implement throughout the movement of the lift arms.

2. The linkage arrangement as set forth in claim 1 wherein the lifting means includes a pair of fluid actuated cylinders having first and second end portions, said first end portions being connected to the vehicle frame at spaced locations that are generally in vertical alignment with and beneath the respective mountings of the first end portions of the lift arms and said second end portions being connected to the respective lift arms at a central portion thereof.

3. A linkage arrangement as set forth in claim 1 wherein the electronic control means includes a plurality of sensors to measure the amount of movement of the lift arms about the mounting of the first end portion thereof and the rotation of the work implement with respect to the lift arms.

4. The linkage arrangement as set forth in claim 3 wherein the electronic control means includes a plurality of displacement sensors that are positioned within the fluid actuated cylinders of the lifting and tilting means to determine the positions of the lift arms with respect to the frame and the work implement with respect to the lift arms.

5. The linkage arrangement as set forth in claim 3 wherein the electronic control means includes a plurality of rotational angle sensors to measure the amount of movement of the lift arms about the mounting of the first end portions thereof and the rotation of the work implement with respect to its mounting to the lift arms.

6. The linkage arrangement as set forth in claim 4 wherein the electronic control means further includes a controller that receives the output from the sensors to determine the current positions of the lift arms and work implement, compares the respective current positions with that of a preselected desired position for the respective components and produces an output that actuates an electro-hydraulic valve that is associated with the fluid actuation cylinders of the lift and tilt means to adjust their respective positions in accordance with the preselected positions of the lift arm and work implement.

7. In a vehicle having a frame and being adapted to utilize a plurality of work implements, a linkage arrangement adapted to attach said implements to said frame, comprising:

a pair of lift arms having first and second end portions, said lift arms being mounted in spaced, parallel relation to one another with the first end portions thereof being pivotally mounted to the frame and the second end portion thereof being pivotally mounted to one of said work implements;

a tilt linkage associated with each lift arm having a first tilt link having a first end portion pivotally mounted to the work implement and second end portion, and a second tilt link having a first end portion pivotally connected to the lift arm and a second end portion pivotally mounted to the first tilt link at a location that is intermediate the end portions of the first tilt link, said tilt linkage being positioned in generally vertical alignment with the respective lift arms and being sufficient to provide rotational movement of the work implement about its mounting with the lift arms;

a first fluid actuator pivotally connected directly between the vehicle frame and each of the respective lift arms to provide movement of the lift arms in a generally vertical plane, each of said first fluid actuators being positioned to be generally in vertical alignment with the respective lift arm and its mounting to the vehicle frame;

a second fluid actuator pivotally connected between each tilt linkage and the vehicle frame, said fluid actuator being positioned so as to be generally in vertical alignment with the respective lift arms and tilt linkage; and means for sensing the current position of the respective lift arms with respect to the vehicle, and the work implement with respect to the lift arms and providing coordinated manipulation of the first and second fluid actuators to move the lift arms and the work implement through a preselected sequence of maneuvers to a preselected position.

8. The linkage arrangement as set forth in claim 7 wherein the first and second fluid actuators are hydraulic cylinders that further include:

a first end portion attached to the frame;

a second end portion that extends from the first end portion and is attached to one of the respective lift arms and tilt linkages, said second end portions being moveable with respect to the first end portions to cause pivotal movement of the respective lift arms and work implements; and a displacement sensor positioned within the first end portion to determine the amount of movement between the first and second end portions thereof.

9. The linkage arrangement as set forth in claim 7 wherein rotation angle sensor is connected to selected pivotal mountings of the lift arms, tilt linkage and work implement to determine the joint angle measurements of the lift arms and work implement relative to their respective mountings.

10. The linkage arrangement as set forth in claim 7 wherein a controller is in communication with the output of one of the sensing means to determine the actual position of the work implement and the lift arms and compare the actual position thereof with preselected positions of the lift arms and work implement that have been programmed therewithin.

11. The linkage arrangement as set forth in claim 10 wherein an electro-hydraulic actuator is in communication with the first and second fluid actuators and is responsive to an output from the controller to control the movement of the first end portion of the fluid actuators with respect to the second end portions thereof, to provide automatic operation of the fluid actuators.

12. In a vehicle having a frame and being of a construction sufficient for manipulating a plurality of work implements, a linkage arrangement adapted to mount the work implement to the vehicle comprising:

a pair of lift arms, each having a first end portion pivotally mounted to the frame and a second end portion pivotally mounted to the work implement, said lift arms being spaced from one another on a lift cylinder operatively associated with each lift arm, said lift cylinders having a first end portion pivotally mounted to the frame, and a second end portion pivotally mounted to one of the respective lift arms, said lift cylinders being positioned in general alignment with the respective lift arms and being operable for moving the lift arms in a generally vertical plane about the mounting of the first end portion of the lift arms;

a first tilt link operatively associated with each lift arm and having a first and second end portion, said first end portion being pivotally mounted to the work implement in spaced, generally vertical alignment with the mounting of the second end portion of each lift arm;

a pair of second tilt links operatively associated with each lift arm, each having a first end portion pivotally connected to the lift arm on opposite sides thereof and a second end portion pivotally mounted to the first tilt link on opposite sides thereof at a location that is intermediate the first and second end portions of the first tilt link to form an extension between the point of attachment between the first and second tilt links;

a tilt cylinder operatively associated with each lift arm and having a first end portion mounted directly to the frame and a second end portion mounted to the second end portion of each first tilt link, said tilt cylinder being positioned to be spaced vertically above and in general vertical alignment with each of the respective lift arms; and electronic control means for sensing the actual position of the lift arms with respect to the vehicle frame and the work implement with respect to the lift arms, calculating the variance between the respective actual positions and that of one of a plurality of preselected, programmable positions, and actuating the lift and tilt cylinders to reuse the movement of the lift arms and work implement in accordance with the preselected positions.

13. The linkage arrangement as set forth in claim 12 wherein the lift and tilt cylinders each include a cylinder body and a rod member that is reciprocally mounted within the cylinder body for movement between an extended and retracted position.

14. The linkage arrangement as set forth in claim 13 wherein the electronic control means includes a position sensor in the form of a displacement sensor that is positioned within each of the lift and tilt cylinders to determine the amount of extension of the rod member with respect to the cylinder body.

15. The linkage arrangement as set forth in claim 14 wherein the electronic control means includes a position sensing means in the form of a rotational angle sensor one of which is positioned about the pivotal connections between the lift arms and the frame and another of which is positioned about one of the pivotal mountings of the work implement or tilt linkage associated therewith, said rotational angle sensing means being of a construction sufficient for measuring the variance in angles between the selected relatively rotating components.

16. The linkage arrangement as set forth in claim 15 wherein the electronic control means includes a controller that receives the input from the sensing means and compares them to a preselected programmed position for the lift arms and the work implement contained within the controller and provides an output for manipulating the lift and tilt cylinders to position the lift arms and work implement in accordance with the preselected positions.

17. The linkage arrangement as set forth in claim 12 wherein the lift and tilt cylinders are in communication with an electro-hydraulic actuator that receives an output from the electronic control means and hydraulically actuates the lift and tilt cylinders in response thereto.

18. A linkage arrangement adapted for connecting a work implement to the frame of a vehicle comprising:

a pair of lift arms having a first end portion connected to the vehicle frame and a second end portion connected to the work implement, said lift arms being positioned in spaced, parallel relation to each other on opposite sides of a longitudinal centerline (X) defined by the vehicle;

a pair of lift cylinders having first and second end portions, said first end portions being connected to the vehicle frame at spaced locations that are generally in vertical alignment with and beneath the respective mountings of the first end portions of the lift arms and said second end portions being connected to the respective lift arm at a central portion thereof, said lift cylinders being so constructed and adapted to provide rotational movement of said lift arms about said first end portions, said movement being in a substantially vertical plane;

a pair of first links having first and second end portions, said first links being laterally spaced from one another and positioned in generally vertical alignment with the lift arms, said first end portion of each first link being pivotally connected to said work implement;

a pair of second links having first and second end portions, each of said second links being associated with opposing ones of the lift arms and the first links so as to be laterally spaced from one another in generally vertical alignment with the lift arms said first end portion of each second link being pivotally connected to the respective lift arm, said second end portion of each second link being pivotally connected to the respective first link at a point that is intermediate it end portions a pair of tilt cylinders having first and second end portions, said first end portion being pivotally connected directly to said frame, said second end portion of each tilt cylinder being pivotally connected to the second end portion of the respective first link, said tilt cylinders being positioned in generally vertical alignment with the lift arms in a manner sufficient to provide rotational movement of said work implement about said lift arms;

means for sensing the actual position of the lift arm with respect to the frame and responsively producing a first position signal;

means for sensing the actual position of the work implement with respect to the lift arm and responsively producing a second position signal; and electronic control means receiving said first and second position signals and responsively actuating said lift cylinder and said tilt cylinder in accordance with a set of predetermined steps.

19. A linkage arrangement, as set forth in claim 18, wherein said lift arm position sensing means and said work implement position sensing means each include a rotation angle sensor.

20. A linkage arrangement, as set forth in claim 18, wherein said lift arm position sensing means and said work implement position sensing means each include a cylinder extension sensor.

21. A linkage arrangement, as set forth in claim 18, wherein said electronic control means includes a programmable microprocessor.

22. A linkage arrangement, as set forth in claim 18, wherein said electronic control means implements a position feedback control.

23. A linkage arrangement, as set forth in claim 18, including:

a first control lever movable in two directions along an axis and responsively producing a first control signal;

a second control lever movable in two directions along an axis and responsively producing a second control signal;

wherein said electronic control means includes means for receiving said first control signal and responsively actuating said lift cylinders and for receiving said second control signal and responsively actuating said tilt cylinders.

24. A linkage arrangement, as set forth in claim 23, wherein said electronic control means includes means for determining an angular relationship of said work implement with respect to said work vehicle and for maintaining said angular relationship during movement of said lift arm.

25. A linkage arrangement, as set forth in claim 23, wherein said electronic control means includes means for positioning said work implement at a plurality of predetermined positions through actuation of said lift and tilt cylinders.

* * * * *

UNITED STATES PATENT AND TRADEMARK OFFICE

CERTIFICATE OF CORRECTION

PATENT NO. : 5,188,502

DATED : February 23, 1993

INVENTOR(S) : Andrew J. Tonsor et al.

It is certified that error appears in the above-identified patent and that said Letters Patent is hereby corrected as shown below:

Column 13, line 24, after the word "output" insert --signal--.

Column 13, line 59, after the word "connected" insert --directly--.

Column 14, line 17, delete "sensor" and insert --sensors are --

Column 14, line 44, after "on" insert --opposite sides of a longitudinal vehicle centerline;--.

Column 15, line 14, delete "reuse" and insert --cause--.

Column 16, line 20, delete "it" and insert --its--.

Signed and Sealed this

Twenty-second Day of March, 1994

*Attest:*

Bruce Lehman

BRUCE LEHMAN

*Attesting Officer*

*Commissioner of Patents and Trademarks*